US009478906B2

(12) United States Patent
Myer et al.

(10) Patent No.: US 9,478,906 B2
(45) Date of Patent: Oct. 25, 2016

(54) CONNECTOR MATING ASSURANCE

(71) Applicant: TYCO ELECTRONICS CORPORATION, Berwyn, PA (US)

(72) Inventors: John Mark Myer, Millersville, PA (US); Hurley Chester Moll, Hershey, PA (US); Edmond Pendleton de Chazal, Rochester, MI (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 15 days.

(21) Appl. No.: 14/656,846

(22) Filed: Mar. 13, 2015

(65) Prior Publication Data

US 2015/0270643 A1 Sep. 24, 2015

Related U.S. Application Data

(60) Provisional application No. 61/954,761, filed on Mar. 18, 2014.

(51) Int. Cl.
*H01R 13/627* (2006.01)
*H01R 13/641* (2006.01)

(52) U.S. Cl.
CPC ..... *H01R 13/6273* (2013.01); *H01R 13/6272* (2013.01); *H01R 13/641* (2013.01)

(58) Field of Classification Search
CPC ..... H01R 13/6272; H01R 13/6273; H01R 13/6275; H01R 13/506; H01R 13/639; H01R 13/641
USPC ..... 439/357, 352, 353, 489
See application file for complete search history.

(56) References Cited

U.S. PATENT DOCUMENTS

| | | | | |
|---|---|---|---|---|
| 5,507,666 | A | 4/1996 | Yamanashi | |
| 6,261,115 | B1 * | 7/2001 | Pederson | H01R 13/641 439/352 |
| 6,406,319 | B2 * | 6/2002 | Pederson | H01R 13/641 439/352 |

(Continued)

FOREIGN PATENT DOCUMENTS

| | | |
|---|---|---|
| EP | 0 977 322 A2 | 2/2000 |
| JP | H02 56371 U | 4/1990 |
| KR | 2009 0104173 A | 10/2009 |

OTHER PUBLICATIONS

International Search Report, International Application No. PCT/US2015/020642, International Filing Date Mar. 16, 2015.

*Primary Examiner* — Tulsidas C Patel
*Assistant Examiner* — Travis Chambers

(57) ABSTRACT

A connector position assurance device, an electrical connector and an electrical connector assembly which provides proper connector position assurance of a connector assembly of small size. The connector position assurance device has a base portion, a first beam and a second beam. The first and second beams extend from the base portion. The base portion includes a latch engagement protrusion. A first beam has a first connector engagement protrusion and a second beam has a second connector engagement protrusion. The first and second connector engagement protrusions are resiliently actuated as the plug is mated to the header. The first and second connector engagement protrusions and the latch engagement protrusion cooperate with the plug when the plug is fully mated to the header to prevent the inadvertent removal of the plug from the header.

19 Claims, 7 Drawing Sheets

(56) References Cited

U.S. PATENT DOCUMENTS 6,780,045 B2 * 8/2004 Hall, Jr. ..... H01R 13/641 439/352
6,824,417 B1 * 11/2004 Nimura ..... H01R 13/641 439/352
7,399,195 B2 * 7/2008 Kim ..... H01R 13/641 439/352
7,404,731 B2 * 7/2008 Lim ..... H01R 13/641 439/358
7,909,638 B2 * 3/2011 Seo ..... H01R 13/6272 439/352
8,137,142 B1 * 3/2012 Dawson ..... H01R 13/639 439/676
8,920,187 B2 * 12/2014 Kon ..... H01R 13/641 439/352
2001/0027058 A1 * 10/2001 Pederson ..... H01R 13/641 439/595
2013/0337677 A1 12/2013 Puckett et al.

* cited by examiner

CONNECTOR MATING ASSURANCE

CROSS REFERENCE TO RELATED PATENT APPLICATIONS

This application claims benefit of U.S. Provisional Application No. 61/954,761, filed Mar. 18, 2014, entitled "CONNECTOR ASSEMBLY", which Application is herein incorporated by reference in its entirety.

FIELD OF THE INVENTION

The present invention is directed to a connector position assurance device, an electrical connector and an electrical connector assembly which provides proper connector position assurance to assure that the mating connectors are properly mated. In particular the connector position assurance device, the electrical connector and the electrical connector assembly which provides proper connector position assurance for a connector assembly of small size.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. In order to be sure that the first and second housings are properly connected with the electrical contacts electrically engaged, the first and second housing are provided with a latch assembly more generally referred to as a position assurance feature. In known applications, the latch assembly includes a base plate, a suspended prong on the first housing and a ramp on the second housing. The base plate is slidably retained beside the prong. When the first housing is inserted about the second housing, the prong snaps over the ramp and the base plate is then slid over the ramp and the prong into an engagement position. In many applications an audible click is typically used to detect if the connector is fully mated, however, noise at the assembly plant can make this ineffective.

Additionally, electrical connectors have been proposed that utilize a latch or retention assembly to maintain connector halves in a fully mated position, along with a connector position assurance (CPA) device. When the connector halves are mated and the latch or retention assembly is positioned to maintain contact between the connector halves, the connector position assurance device is moved to a position that indicates the connector halves are properly connected. Thus, the connector position assurance device provides a means to assure that the connector halves are fully mated.

Known connector position assurance devices require a significant space as compared to the first and second housings. Consequently, known connector position assurance devices are not practical with small connectors, as the connector size limits how the connector position assurance can interact with the housings. In addition, even when using known connector position assurances, a significant amount of connectors fail to mate properly. For example, the largest warranty problem with automotive connectors is that the connectors are not fully mated, causing system failures after the automobile has left the assembly plant. This is due to the fact that at the vehicle assembly plant, some connectors are mated far enough to make initial, electrical contact but the latches of the connectors are not fully engaged causing the connectors to not be locked or secured together. These connectors later come apart in the field, as the vehicle is driven on bumpy roads etc. causing loss of system function. Even incorporating known connector position assurances into the connectors does not guarantee that the connectors will be properly mated and secured, as in many instances the operator does not properly activate the connector position assurances.

It would be beneficial to have a connector position assurance device which overcomes the problems identified above and which provides proper connector position assurance for a connector assembly of small size. It would also be beneficial to prevent or block the connector position assurance from its fully engaged position if the connector is partially mated or not mated at all.

SUMMARY OF THE INVENTION

An embodiment of the invention is directed to an electrical connector assembly having a plug, header and connector position assurance device. The connector position assurance device includes a first and second protrusion. The second protrusion is activated by the plug latch when the plug and header are fully mated.

An embodiment of the invention is directed to a connector position assurance device having a base portion and beams extending therefrom. The base portion includes a top surface, a bottom surface, a base front end and a base back end, a latch engagement portion extending from the top surface. At least one of the beams extends from the front end of the base portion in a direction away from the base back end. The at least one of the beams has a top side, a bottom side, a beam front end and a beam back end, the beam back end being attached to or integral with the base front end. A mating connector engagement protrusion extends from a resiliently deformable first leg provided proximate the top side of the at least one of the beams. The mating connector engagement protrusion extends in a direction away from the bottom side. The connector position assurance device is maintained in an initial position on a connector until the mating connector cooperates with the mating connector engagement protrusion to force the protrusion and the resiliently deformable first leg toward the bottom side of the at least one of the beams.

An embodiment of the invention is also directed to a connector having a connector position assurance device. The connector includes a latch extending from a housing of the connector. A connector position assurance receiving opening is positioned proximate the latch. Connector position assurance engagement projections extend into the connector position assurance receiving opening. A connector position assurance device is positioned in the connector position assurance receiving opening. The connector position assurance device includes a base portion which has a top surface, a bottom surface, a base front end and a base back end, a latch engagement protrusion extending from the top surface. A beam extends from the front end of the base portion in a direction away from the base back end. The beam has a top side, a bottom side, a beam front end and a beam back end, the beam back end being attached to or integral with the base front end. A mating connector engagement protrusion extends from a resiliently deformable first leg provided proximate the top sides of the beam. The mating connector engagement protrusion extends in a direction away from the bottom side. A first notch is provided along the top sides of the beam proximate the mating connector engagement protrusion. The first notch has side walls which are essentially perpendicular to a bottom wall of the first notch. The side walls act as a stop surface to prevent the connector position assurance device from being moved from an initial position in the connector position assurance receiving opening until the mating connector engagement protrusion and the resiliently deformable first leg are moved toward the bottom sides of the beams.

An embodiment of the invention is also directed to an electrical connector assembly include a plug having a latch, a header, and a connector position assurance device. The connector position assurance device has a base portion, a first beam and a second beam. The first and second beams extend from the base portion. The base portion includes a latch engagement protrusion. A first beam has a first connector engagement protrusion and a second beam has a second connector engagement protrusion. The first and second connector engagement protrusions are resiliently actuated as the plug is mated to the header. The first and second connector engagement protrusions and the latch engagement protrusion cooperate with the plug when the plug is fully mated to the header to prevent the inadvertent removal of the plug from the header.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
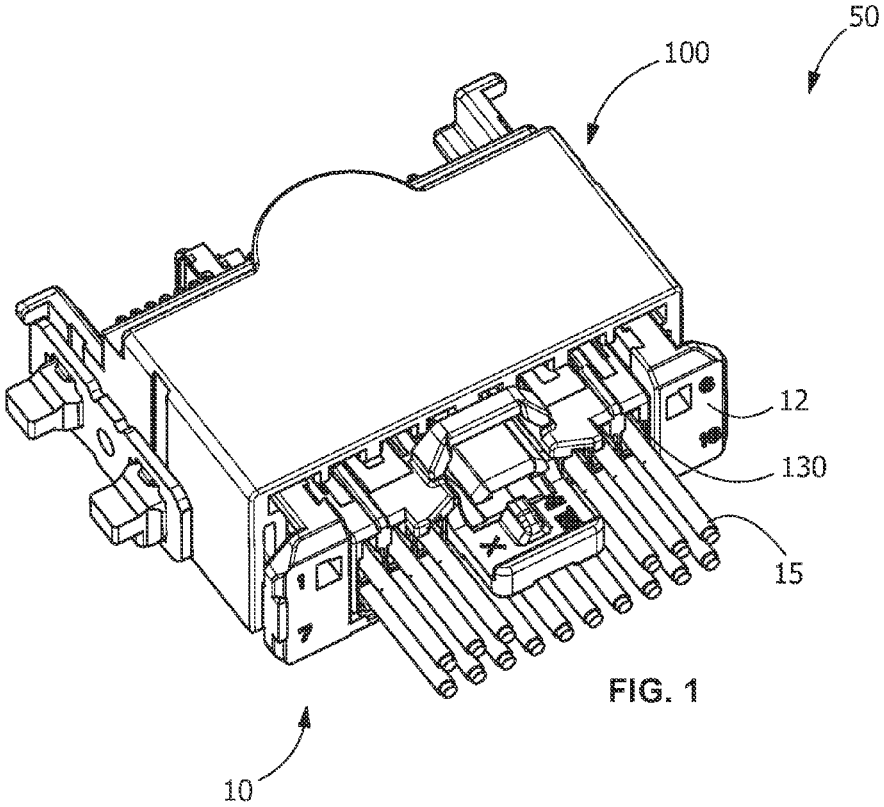
FIG. 1 is a perspective view of a plug connector mated with a header or mating connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 shows a perspective view of an electrical connector or plug 10 mated with a mating connector or header 100 which together form a connector assembly 50. The electrical connector 10 and mating connector 100 are shown as a representations. The connectors 10 and 100 will have many other features, such as contacts and contact latches, which are not shown in the figures.

Figure 2:
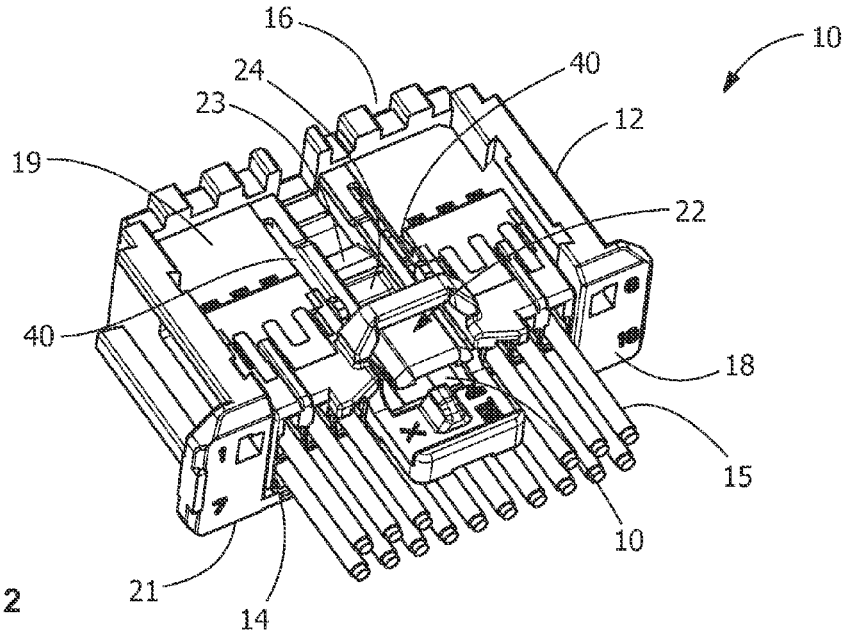
FIG. 2 is a top perspective view of the plug connector of FIG. 1.

Referring to FIG. 2, the electrical connector 10 has a housing body 12 with contact receiving passages 14 for receiving contacts therein, not shown. The electrical connector 10 has a forward mating end 16 and a rearward end 18. Conductors or wires 15, which are in electrical engagement with the contacts (not shown) are inserted in the passages 14 and extend from the rearward end 18. A first or top surface 19 and an oppositely facing second or bottom surface 21 extend between the mating end 16 and the rearward end 18.

A latch or latch arm 22 having an engagement surface 23 and a latching opening 24 extends from the top surface 19. In the embodiment shown, the latch 22 is connected to the top surface 19 proximate the forward mating end 16 and extends toward the rearward end 18. The latch 22 is used to latch and secure the mating connector 100 to the connector 10, as will be more fully described below.

Figure 6:
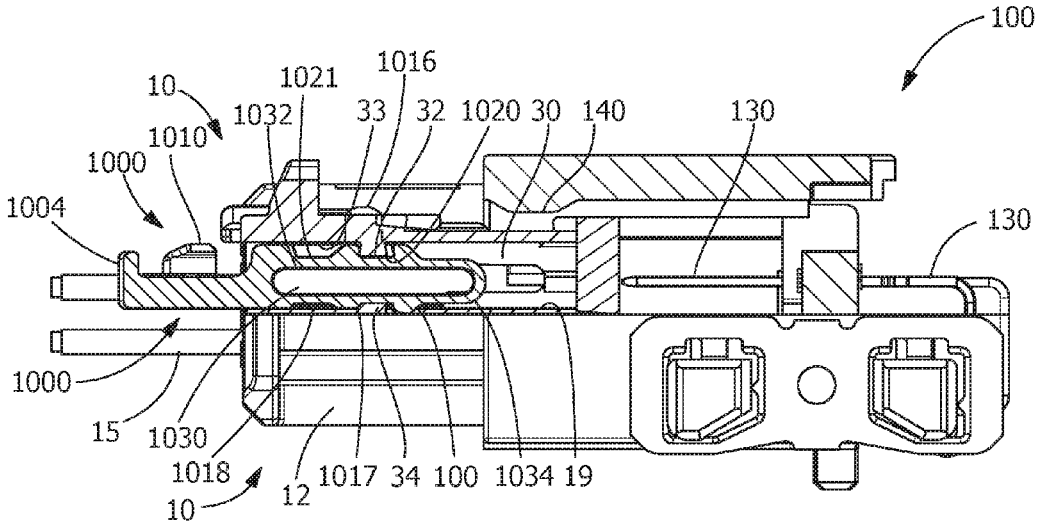
FIG. 6 is a cross-sectional view taken through a respective beam of the connector position assurance member showing the plug or connector partially inserted into the header or mating connector, with the connector position assurance member in an initial position.

As shown in FIG. 6, extending between the latch arm 22 and the housing body 12 is a connector position assurance (CPA) receiving opening 30. An upper knob or connector position assurance engagement projection 32 extends into the connector position assurance receiving opening 30 from a lower surface 33 of the housing body 12. A lower knob or connector position assurance engagement projection 34 extends into the connector position assurance receiving opening 30 from the top surface 19 of the housing body 12. Channels 40 (FIG. 2) are provided proximate the latch arm 22 and respective support walls (not shown) which extend from the top surface 19. The channels 40 cooperate with the connector position assurance receiving opening 30 to house a portion of the connector position assurance member 1000 therein, as will be more fully discussed.

Figure 3:
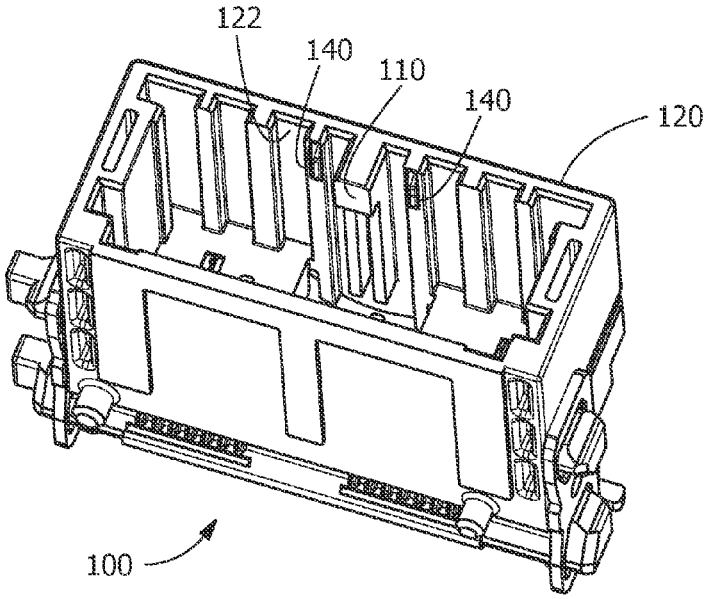
FIG. 3 is a front perspective view of the header or mating connector of FIG. 1.

As best shown in FIG. 3, the mating connector 100 has a complimentary latching protrusion 110 which is positioned to engage the latch arm 22 as the connector 10 and the mating connector are moved from an unmated position to a mated position. In the embodiment shown, the latching protrusion 110 extends from a surface 122 of a shroud 120 of the mating connector 100.

When properly mated together, the latching protrusion 110 cooperates with and is positioned in the latching opening 24 to secure the mating connector 100 with the electrical connector 10. In the mated position, the connector 10 is received within the shroud 120 of the mating connector 100. Electrical contacts 130 (FIG. 11) of the mating connector 100 mate with electrical contacts (not shown) in the electrical connector 10.

Connector position assurance engagement ribs or projections 140 are provided on either side of the latching protrusion 110. The engagement projections or ribs 140 are spaced from the latching protrusion 110 and extend from the surface 122 of the shroud 120 of the mating connector 100. In the embodiment shown, the latching protrusion 110 extends a further distance from the surface 122 of than does the engagement projections 140.

Figure 5:
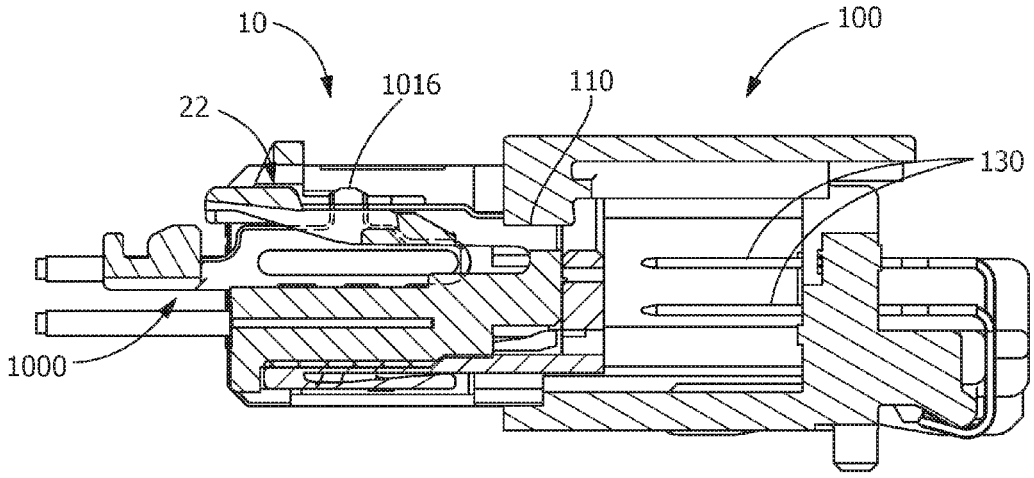
FIG. 5 is a cross-sectional view taken through a latch engagement portion of the connector position assurance member showing the plug or connector partially mated to the header or mating connector, with the connector position assurance member in an initial position.
Figure 11:
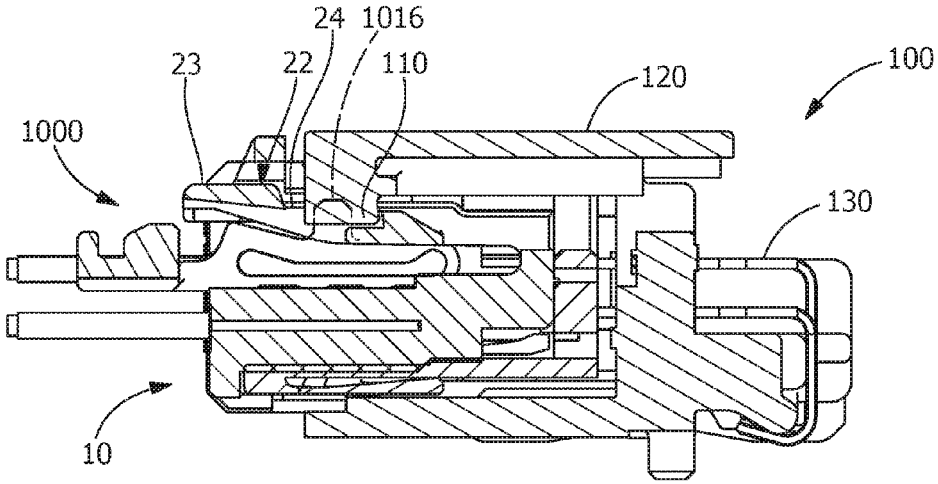
FIG. 11 is a cross-sectional view taken through the latch engagement portion of the connector position assurance member showing the plug or connector fully mated to the header or mating connector, the connector position assurance member remains in the initial position.
Figure 12:
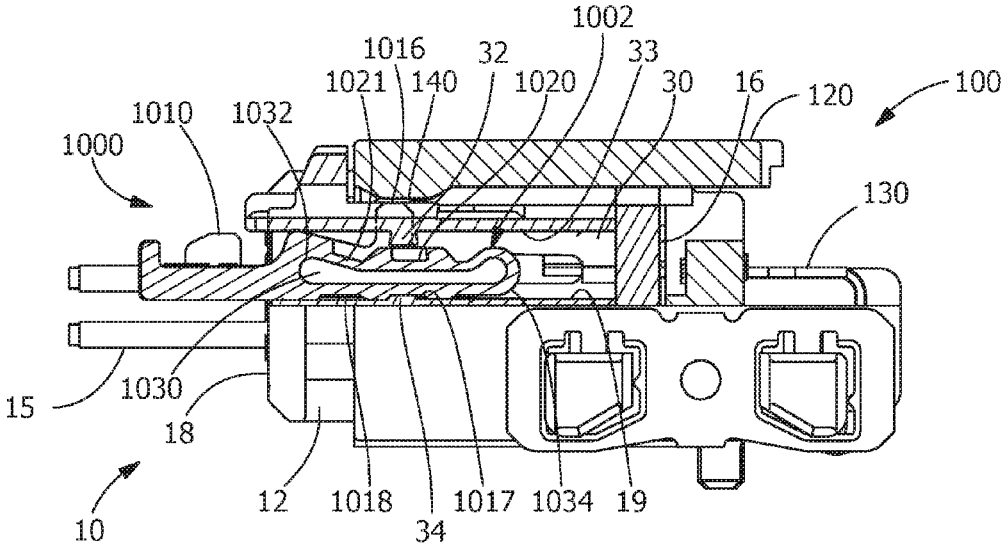
FIG. 12 is a cross-sectional view taken through the respective beam of the connector position assurance member showing the plug or connector fully mated to the header or mating connector, the connector position assurance member remains in the initial position.
Figure 13:
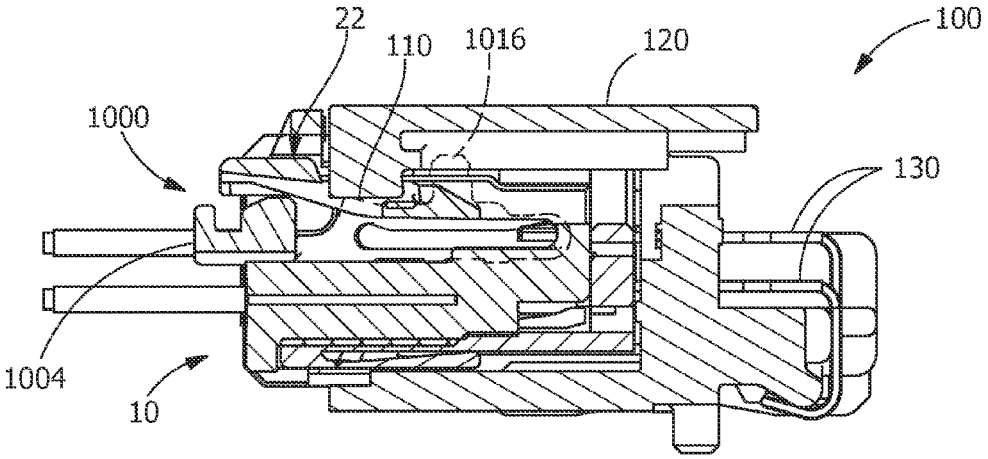
FIG. 13 is a cross-sectional view taken through the latch engagement portion of the connector position assurance member showing the plug or connector fully mated to the header or mating connector, the connector position assurance member is moved to a locked position.

As shown in FIGS. 5-14, a connector position assurance device 1000 is positioned proximate to and is movable relative to the latch arm 22 of the connector 10. The connector position assurance device is maintained in the connector position assurance receiving opening 30 and is movable between a first position or open position, as shown in FIG. 5, and a second or fully inserted position, as shown in FIG. 13.

Figure 4:
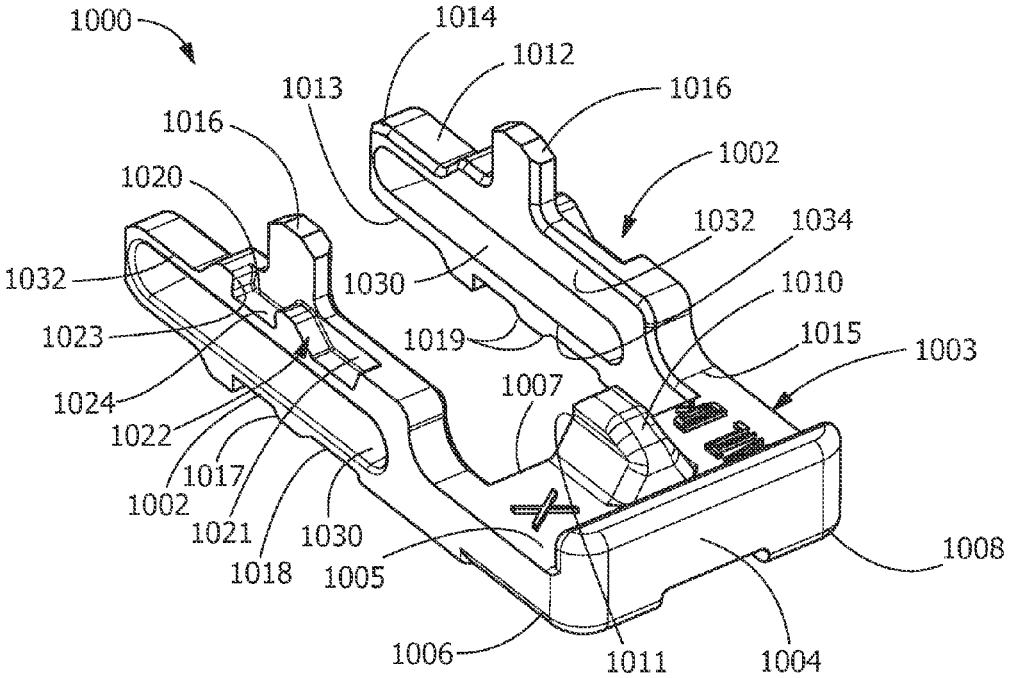
FIG. 4 is a top perspective view of the connector position assurance member.

Referring to FIG. 4, the connector position assurance device 1000 is generally U-shaped having a base portion 1003 and two parallel beams 1002. The base portion 1003 is generally a rectangular plate having a top surface 1005, a bottom surface 1006, a base front end 1007 and a base back end 1008. The beams 1002 extend from the front end 1007 in a direction away from the back end 1008. The base portion 1003 includes a press bar 1004 extending along the back end 1008 for manually engaging or activating the connector position assurance device 1000, as will be more fully described. In the illustrative embodiment shown, the press bar 1004 extends across the entire width of the back end 1008. However, other configurations may be used without departing from the scope of the invention. A latch engagement protrusion 1010 extends from the top surface 1005 of the base portion 1003. As will be described further below, the latch engagement protrusion 1010 interacts with the latch 22.

The beams 1002, as best shown in FIG. 4, are generally rectangular in shape. Each beam 1002 has a top side 1012, a bottom side 1013, a beam front end 1014 and a beam back end 1015. The back end 1015 is attached to or is integral with the front end 1007 of the base portion 1003. A mating connector engagement protrusion 1016 extends from the top side 1012 of each beam 1002, in a direction away from the bottom side 1013. In the illustrative embodiment shown, each protrusion 1016 extends from a resiliently deformable top or first leg 1032 of the beam 1002. In the illustrative embodiment shown, the protrusion 1016 is positioned generally or approximately midway between the front end 1014 and the back end 1015 of the beam 1002. Each beam 1002 has an opening 1030 which extends through a portion of the beam 1002 to form the top leg 1032 and a bottom leg 1034.

First and second notches 1017, 1018 are provided along the bottom side 1013 of the beams 1002. The first and second notches 1017 and 1018 have sloped or angled side walls 1019. The slope of the angle walls 1019 may be adjusted to increase or decrease the force required to move or seat the connector position assurance device 1000. First and second notches 1020, 1021 are provided along the top side 1012 of the beams 1002. The first and second notches 1020, 1021 are provide proximate the protrusion 1016. The second notches 1021 have sloped or angled side walls 1022. The slope of the angle walls 1022 may be adjusted to increase or decrease the force required to move or seat the connector position assurance device 1000. The first notches 1020 have side walls 1023 which are essentially perpendicular to the bottom walls 1024 of the notches 1020. The side walls 1023 act as a stop surface to prevent the connector position assurance device 1000 from being removed from the connector position assurance receiving opening 30.

Referring to FIGS. 5 through 14. The progression or method of inserting the plug or connector 10 into the header or mating connector 100 is shown.

In FIGS. 5 and 6, the connector 10 and the mating connector 100 are shown initially inserted in which the plug connector 10 is loosely positioned in the header connector 100. In this position, the latching protrusion 110 has not engaged the latch 22. As shown, the connector position assurance device 100 is maintained in the pre-mated, open or first position by the cooperation of the first notches 1017, 1020 with the respective projections 34, 32. In this position, the latch 22 is in a normal or undeflected position.

Figure 7:
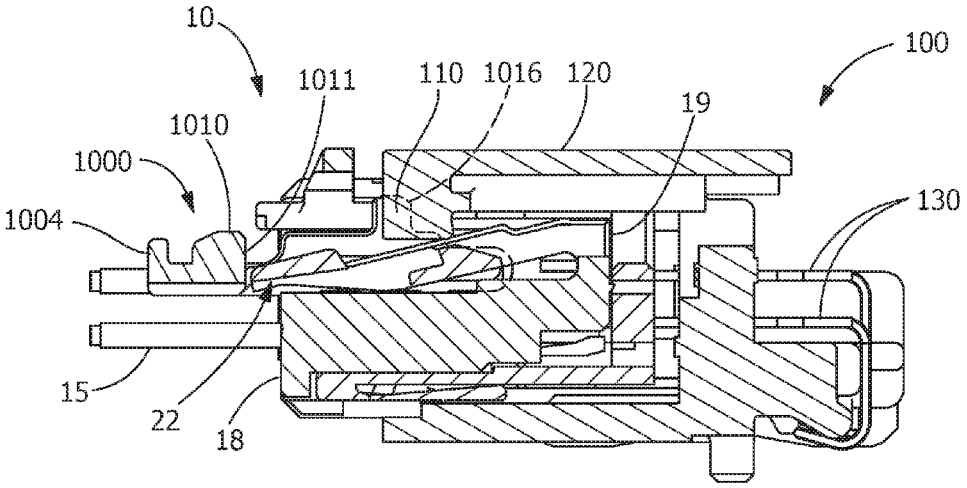
FIG. 7 is a cross-sectional view taken through the latch engagement portion of the connector position assurance member showing the plug or connector more fully mated to the header or mating connector than shown in FIG. 5, the connector position assurance member remains in the initial position.
Figure 8:
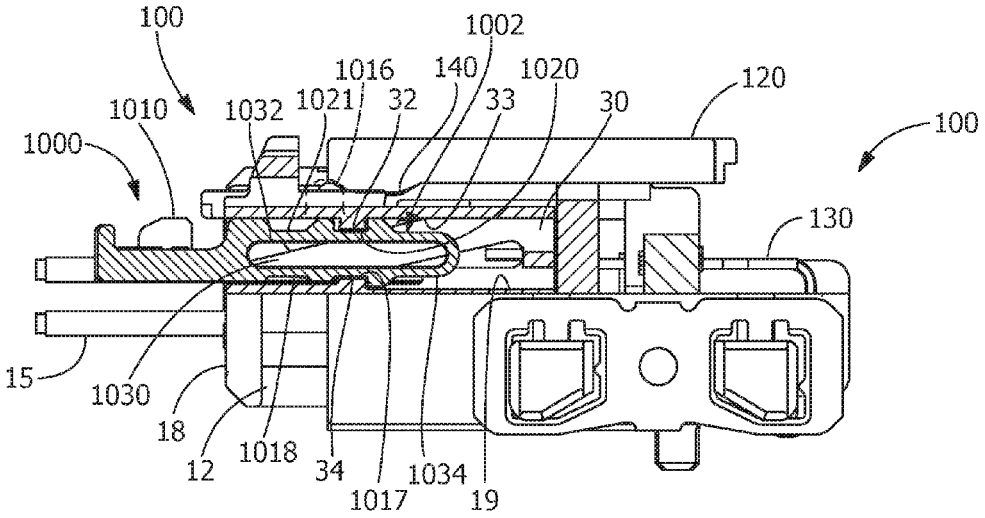
FIG. 8 is a cross-sectional view taken through the respective beam of the connector position assurance member showing the plug or connector more fully mated to the header or mating connector than shown in FIG. 6, the connector position assurance member remains in the initial position.

As the connector 10 is partially inserted into the shroud 120 of the mating connector 100, as shown in FIGS. 7 and 8, the engagement surface 23 of the latch 22 engages the latching protrusion 110 of the mating connector 100, causing the engagement surface 23 and the latch 22 to be resiliently deformed activated or deflected away from the top surface 19 of the connector 10 toward the bottom surface 21 of the connector 10. In addition, the protrusions 1016 provided on the beams 1002 of the connector position assurance device 1000 are moved proximate to, adjacent to, or in initial engagement with the connector position assurance engagement projections 140.

Figure 9:
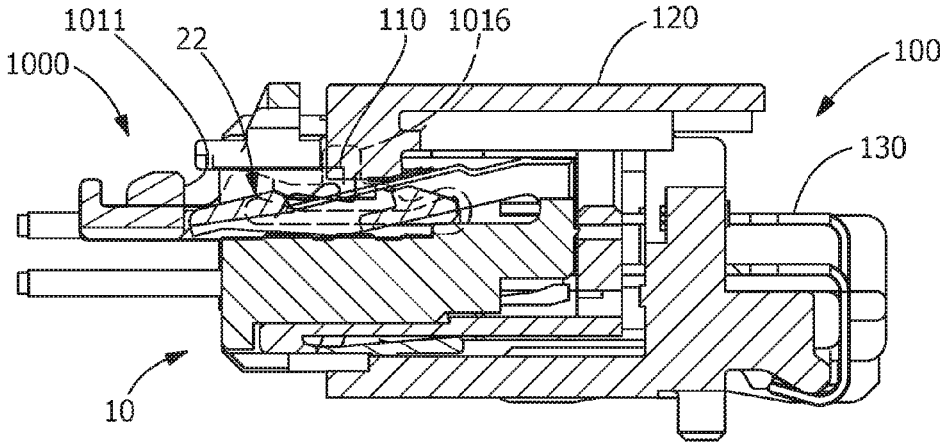
FIG. 9 is a cross-sectional view taken through the latch engagement portion of the connector position assurance member showing the plug or connector more fully mated to the header or mating connector than shown in FIG. 7, the connector position assurance member remains in the initial position.
Figure 10:
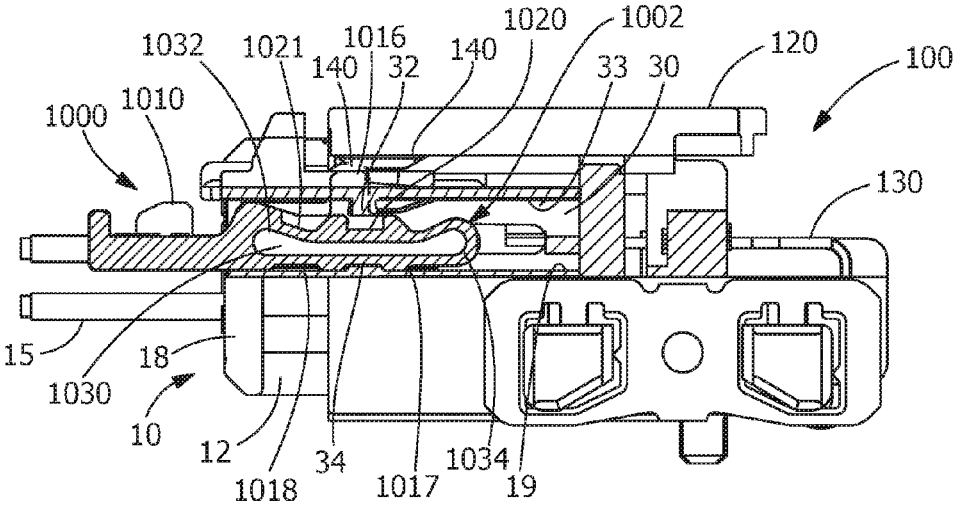
FIG. 10 is a cross-sectional view taken through the respective beam of the connector position assurance member showing the plug or connector more fully mated to the header or mating connector than shown in FIG. 8, the connector position assurance member remains in the initial position.

As insertion continues, as shown in FIGS. 9 and 10, the protrusions 1016 provided on the beams 1002 of the connector position assurance device 1000 are moved along the surface of the connector position assurance engagement projections 140, forcing the protrusions 1016 to move toward the bottom sides 1013 of the beams 1002. As this occurs, the top legs 1032 are elastically deformed into the openings 1030, thereby allowing the first notches 1020 of the top sides 1012 to be moved away from projections 32. However, the connector position assurance device 1000 is maintained is position relative to the connector position assurance receiving opening 30 by the first notches 1017 with the projections 34.

As insertion continues, as shown in FIGS. 11 and 12, the connector 10 is fully inserted into the shroud 120 of the mating connector 100. In this position, the engagement surface 23 will be moved beyond the latching protrusion 110, allowing the latch 22 to resile to its normal, undeflected position. As the latch 22 returns to its undeflected position, the latching protrusion 110 is inserted through the opening 24 of the latch 22, thereby latching the latch 22 on the latching protrusion 110 to secure the connector 10 to the mating connector 100.

Figure 14:
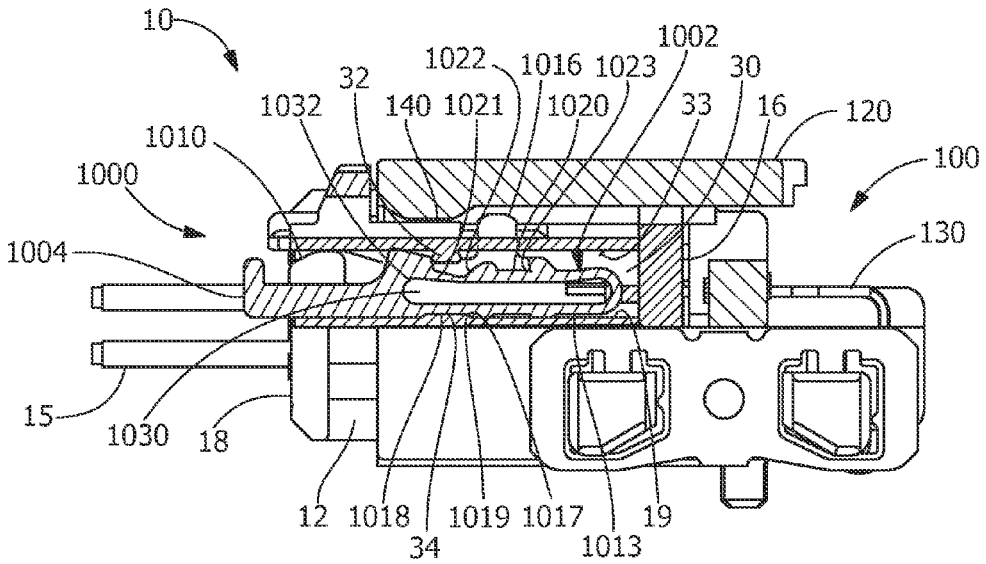
FIG. 14 is a cross-sectional view taken through the respective beam of the connector position assurance member showing the plug or connector fully mated to the header or mating connector, the connector position assurance member is moved to a locked position.

With the connector 10 fully inserted into the shroud 120 of the mating connector 100, the connector position assurance device 1000 can be moved from the initial position to the locked position, as shown in FIGS. 13 and 14. In order to move the connector position assurance device 1000, a force or pressure is applied to the press bar 1004 in the direction of insertion. As the pressure is applied, the projections 34 slide over the angled side walls 1019, allowing the projections 34 to be moved out of the first notches 1017. As the pressure is applied, the connector position assurance device 1000 is moved in the receiving opening 30 toward the mating end 16. Continued insertion allows the protrusions 1016 provided on the beams 1002 of the connector position assurance device 1000 to be moved beyond the surface of the connector position assurance engagement projections 140, allowing the protrusions 1016 to move away from the bottom sides 1013 of the beams 1002. The movement of the protrusions 1016 is due to the top legs 1032 being allowed to resiliently return toward their unstressed position. The insertion continues until the projections 32 are moved into the second notches 1021 of the top sides 1012 and the projections 34 are moved into the second notches 1018 of the bottom sides 1013. In this fully inserted position, latch engagement protrusion 1010 is positioned beneath latch 22, thereby preventing latch 22 from being moved downward. In this position the latch engagement protrusion 1010 blocks the activation of a plug latch 22, which in turn prevents the unwanted or inadvertent unmating of the connector 10 from the mating connector 100.

If the connector 10 is to be unmated from the mating connector 110, the connector position assurance device 1000 is returned to the initial position. A force applied in the press bar 1004 in the opposite direction of insertion, allows the projections 34, 32 to slide over the angled side walls 1019, 1022, allowing the projections 34, 32 to be moved out of the second notches 1018, 1021. As the movement continues, latch engagement protrusion 1010 is moved away from the latch 22, allowing the latch to be depressed, which in turn allows the connector 10 is to be unmated from the mating connector 110.

It is worth noting that the insertion of the connector position assurance device 1000 from the initial position to the locked position is prevented if the connector 10 is not mated to the mating connector 100, as shown in FIGS. 5 and 6. The walls 1023 of the first notches 1020 are configured to prevent the removal of the projection 32 from the first notches 1020 unless the top legs 1032 are elastically deformed into the openings 1030, as previously described. As the top legs 1032 are only deformed by the cooperation of the protrusions 1016 with the engagement projections 140, if no engagement projections 140 are present, the connector position assurance device 1000 cannot be moved to the closed position.

In addition, the connector position assurance device 1000 cannot be moved to the closed or locked position if the connector 10 is not properly or fully mated to the mating connector 100. As shown in FIGS. 7 and 9, if the connector 10 is not completely inserted or is improperly inserted into the mating connector 100, the latch 22 will continue to be deflected from its normal, undeflected position. In this position, the engagement surface 23 of the latch 22 may engage the front end and/or the front surface 1011 of the engagement protrusion 1010, thereby preventing or blocking the continued insertion of the connector position assurance device 1000 toward the seated or closed position. As the connector position assurance device cannot be moved to the locked position, an indication is provided that the connector 10 is not properly inserted within the mating connector 100 and this must be corrected.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector position assurance device comprising:

a base portion having a top surface, a bottom surface, a base front end and a base back end, a latch engagement portion extending from the top surface;

beams extending from the front end of the base portion in a direction away from the back end of the base portion, at least one of the beams having a top side, a bottom side, a beam front end and a beam back end, the beam back end being attached to or integral with the base front end, a mating connector engagement protrusion extending from a resiliently deformable first leg provided proximate the top sides of the at least one of the beams, the mating connector engagement protrusion extending in a direction away from the bottom side;

wherein the connector position assurance device is maintained in an initial position on a connector until the a mating connector cooperates with the mating connector engagement protrusions to force the mating connector engagement protrusion and the resiliently deformable first leg toward the bottom side of at least one of the beams.

2. The connector position assurance device as recited in claim 1, wherein the at least one of the beams has an opening which extends through a portion of the at least one of the beams to form the top legs and bottom legs.

3. The connector position assurance device as recited in claim 1, wherein two beams extend from the base portion to form a generally U-shaped device.

4. The connector position assurance device as recited in claim 1, wherein a press bar is provided on the base portion, the press bar extends along the base back end to allow for manually engaging or activating the connector position assurance device.

5. The connector position assurance device as recited in claim 1, wherein the mating connector engagement protrusion is positioned approximately midway between the beam front end and the beam back end.

6. The electrical connector assembly of claim 1, wherein the first and second connector engagement protrusions extend from the first and second beams of the connector position assurance device through an channels in the plug, wherein when the plug is mated with the header, a latching protrusion on the header engages the first and second connector engagement protrusions to resilient deform portions of the first and second beams.

7. The electrical connector assembly of claim 1, further comprising:

first notches and second notches on bottom legs of the of the first and second beams; and connector position assurance engagement projections on the plug, the connector position assurance engagement projections being proximate the notches;

wherein as the plug is mated to the header the connector position assurance engagement projections move from engagement with the first notches to engagement with the second notches.

8. The connector position assurance device as recited in claim 1, wherein first and second notches are provided along the bottom side of the at least one of the beams.

9. The connector position assurance device as recited in claim 8, wherein the first and second notches have sloped or angled side walls.

10. The connector position assurance device as recited in claim 1, wherein first and second notches are provided along the top side of the at least one of the beams proximate the mating connector engagement protrusion.

11. The connector position assurance device as recited in claim 10, wherein the first notches have side walls which are essentially perpendicular to bottom walls of the first notches, wherein the side walls act as a stop surface to prevent the connector position assurance device from being moved until the mating connector engagement protrusion and the resiliently deformable first leg are moved toward the bottom side of the at least one of the beams.

12. The connector position assurance device as recited in claim 11, wherein the second notches have sloped or angled side walls.

13. A connector having a connector position assurance device, the connector comprising:

a latch extending from a housing of the connector;

a connector position assurance receiving opening positioned proximate the latch, connector position assurance engagement projections extending into the connector position assurance receiving opening;

a connector position assurance device positioned in the connector position assurance receiving opening, the connector position assurance device comprising:

a base portion having a top surface, a bottom surface, a base front end and a base back end, a latch engagement protrusion extending from the top surface;

a beam extending from the front end of the base portion in a direction away from the base back end, the beam having a top side, a bottom side, a beam front end and a beam back end, the beam back end being attached to or integral with the base front end, a mating connector engagement protrusion extending from a resiliently deformable first leg provided proximate the top sides of the beam, the mating connector engagement protrusion extending in a direction away from the bottom side;

a first notch provided along the top side of the beam proximate the mating connector engagement protrusion, the first notch has side walls which are essentially perpendicular to a bottom wall of the first notch;

wherein the side walls act as a stop surface to prevent the connector position assurance device from being moved from an initial position in the connector position assurance receiving opening until the mating connector engagement protrusion and the resiliently deformable first leg are moved toward the bottom side of the beam.

14. The connector position assurance device as recited in claim 13, wherein the latch engagement protrusion has a front surface which cooperates with the latch to prevent the movement of the connector position assurance device to a fully seated position in the connector position assurance receiving opening when the latch is deflected from its undeflected position.

15. The connector position assurance device as recited in claim 13, wherein the mating connector engagement protrusion is positioned approximately midway between the beam front end and the beam back end.

16. The connector position assurance device as recited in claim 15, wherein the beam has an opening which extends through a portion of the beam to form a top leg and a bottom leg.

17. The connector position assurance device as recited in claim 16, wherein a second notch is provided along the top side of the beam, the second notch has sloped or angled side walls.

18. The connector position assurance device as recited in claim 17, wherein third and fourth notches are provided along the bottom side of the beam, the third and fourth notches have sloped or angled side walls.

19. An electrical connector assembly comprising:

a plug having a latch;

a header;

a connector position assurance device having a base portion, a first beam and a second beam, the first and second beams extending from the base portion, the base portion having a latch engagement protrusion, the first beam having a first connector engagement protrusion and the second beam having a second connector engagement protrusion; and wherein the first and second connector engagement protrusions are resiliently actuated as the plug is mated to the header;

wherein the first and second connector engagement protrusions and the latch engagement protrusion cooperate with the plug when the plug is fully mated to the header to prevent the inadvertent removal of the plug from the header;

wherein the latch engagement protrusion blocks the activation of the latch of the plug when the connector position assurance device is in a seated position.

* * * * *